US012370459B1

(12) United States Patent
Anderson

(10) Patent No.: US 12,370,459 B1
(45) Date of Patent: Jul. 29, 2025

(54) MAGNETIC MODULAR DOLL HOUSE

(71) Applicant: Jacquelyn Grace Anderson, Katy, TX (US)

(72) Inventor: Jacquelyn Grace Anderson, Katy, TX (US)

( * ) Notice: Subject to any disclaimer, the term of this patent is extended or adjusted under 35 U.S.C. 154(b) by 188 days.

(21) Appl. No.: 18/377,703

(22) Filed: Oct. 6, 2023

Related U.S. Application Data

(60) Provisional application No. 63/415,903, filed on Oct. 13, 2022.

(51) Int. Cl.
*A63H 3/52* (2022.01)
*A63H 33/04* (2006.01)

(52) U.S. Cl.
CPC ..... *A63H 3/52* (2013.01); *A63H 33/046* (2013.01)

(58) Field of Classification Search
CPC ..... A63H 3/52; A63H 33/046
See application file for complete search history.

(56) References Cited

U.S. PATENT DOCUMENTS 2,570,625 A * 10/1951 Zimmerman ..... A63H 33/046 446/419
4,233,778 A * 11/1980 Lemelson ..... A63H 3/52 446/132
9,072,980 B2 7/2015 Van Tilburg
10,052,251 B1 * 8/2018 Lu ..... A61G 17/08
2002/0193046 A1 * 12/2002 Zebersky ..... A63H 3/52 446/108
2012/0225603 A1 9/2012 Trinch
2020/0139259 A1 5/2020 Rivera De Finkbeiner
2020/0246715 A1 * 8/2020 Bensussan ..... A63H 33/10

FOREIGN PATENT DOCUMENTS

DE 3343098 A1 * 6/1985 ..... A63H 3/52
DE 102011084959 A1 * 4/2013 ..... A63H 3/52

* cited by examiner

*Primary Examiner* — Alexander K Garlen
(74) *Attorney, Agent, or Firm* — Plager Schack LLP; Mark H. Plager; Naomi Mann

(57) ABSTRACT

A magnetic modular dollhouse system enables children to change the dollhouse layout by rearranging rooms and/or adding/removing rooms. In certain embodiments, the dollhouse may comprise individual rooms, wherein two or more rooms may include strategically placed magnets that allows the rooms to "snap" together side to side and/or top to bottom in a directionally guided positional orientation.

8 Claims, 4 Drawing Sheets

MAGNETIC MODULAR DOLL HOUSE

RELATED APPLICATION

This application claims benefit to U.S. Application No. 63/415,903 filed Oct. 13, 2022, which is incorporated by reference herein in its entirety.

BACKGROUND

The present disclosure relates generally to toys and more specifically to doll houses.

Toys that encourage imaginative play by enabling children to manipulate their environment are entertaining and beneficial to cognitive development. As such, novel toys that provide such benefits are desirable.

SUMMARY

According to various embodiments, disclosed is a magnetic modular dollhouse system which enables children to change the dollhouse layout by rearranging rooms and/or adding/removing rooms. In certain embodiments, the dollhouse may comprise individual rooms, wherein 2 or more rooms may include strategically placed magnets that allows the rooms to snap together side to side and/or top to bottom to create a variety of layouts.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

The disclosed subject matter provides a magnetic modular dollhouse 1 which enables children to change the dollhouse layout by rearranging rooms and/or adding/removing rooms.

Figure 1:
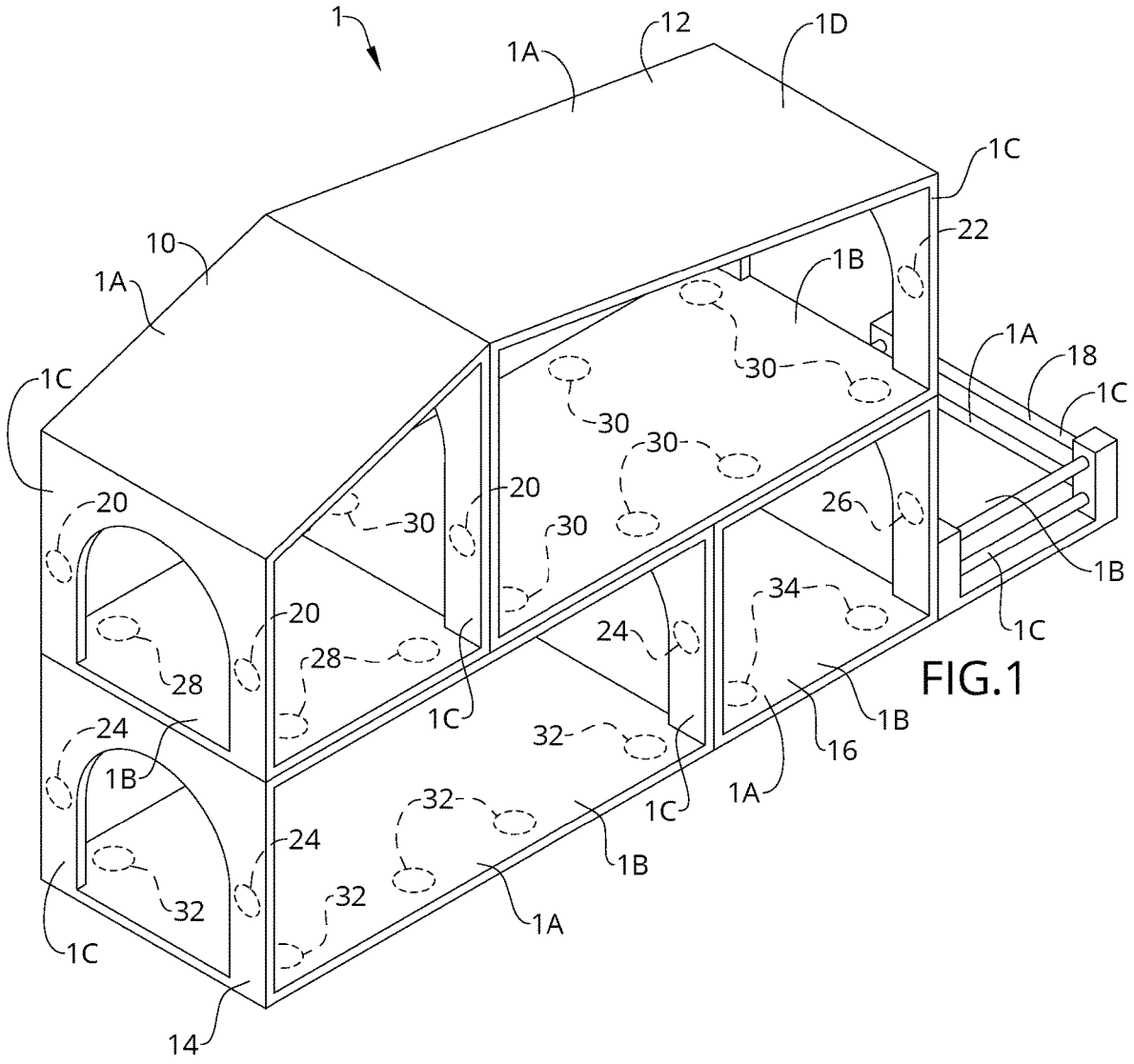
FIG. 1 is a perspective view of a magnetic modular dollhouse in accordance with various embodiments.
Figure 2:
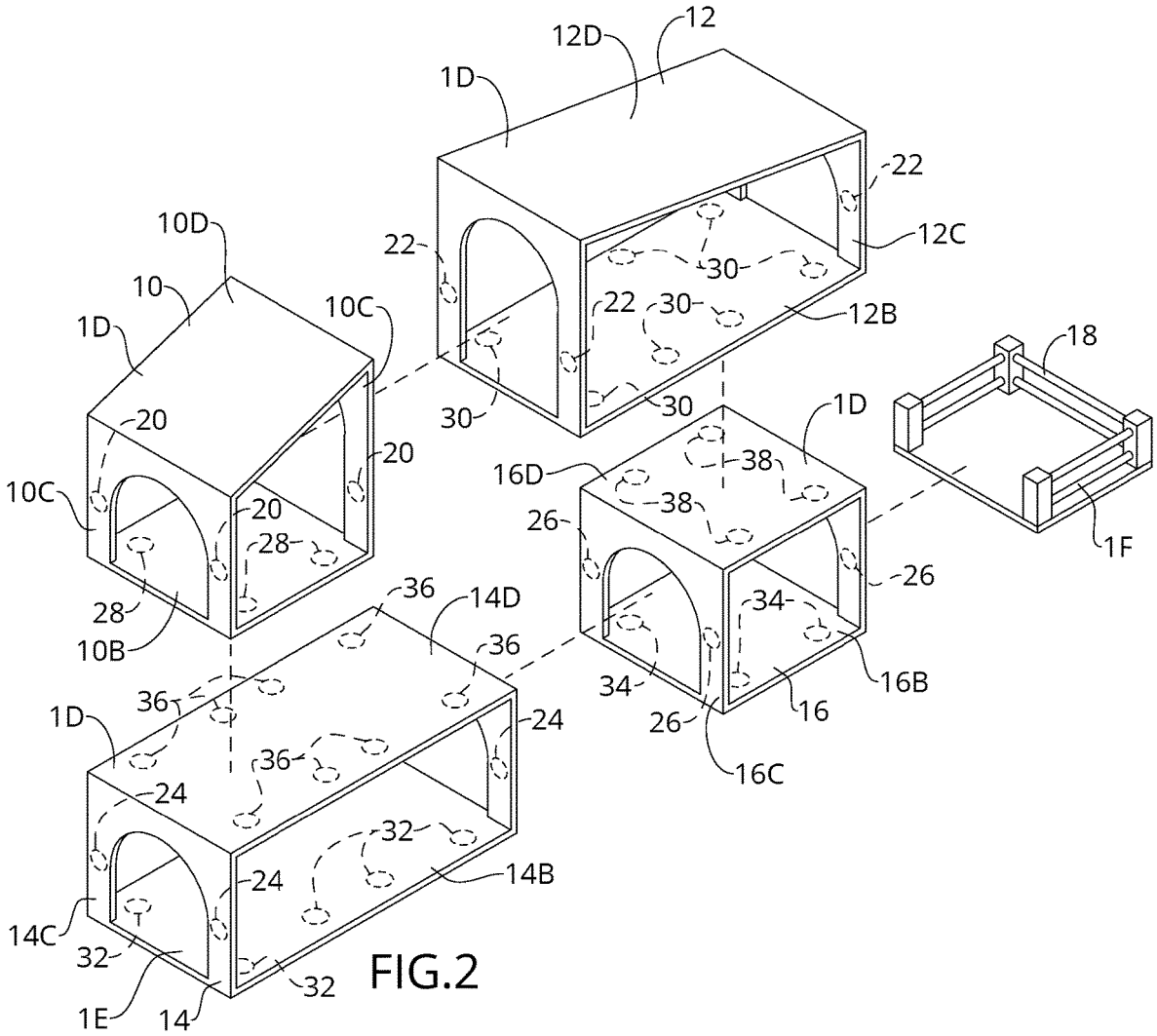
FIG. 2 is an exploded view of the dollhouse.
Figure 3:
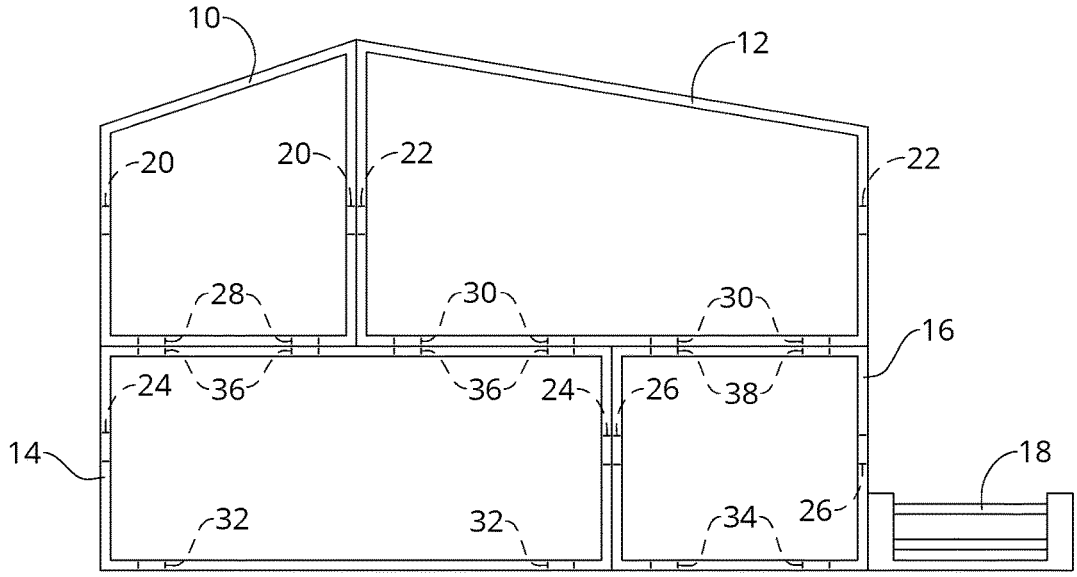
FIG. 3 is a side view thereof.
Figure 4:
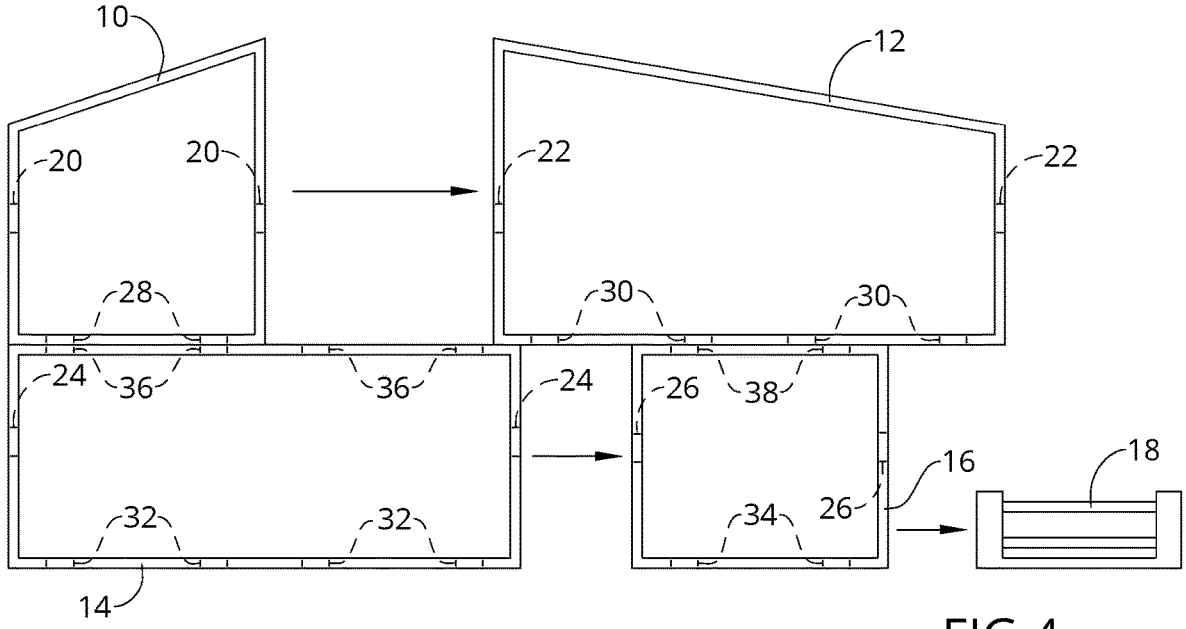
FIG. 4 is a side view illustrating detachment of certain components of the dollhouse.
Figure 5:
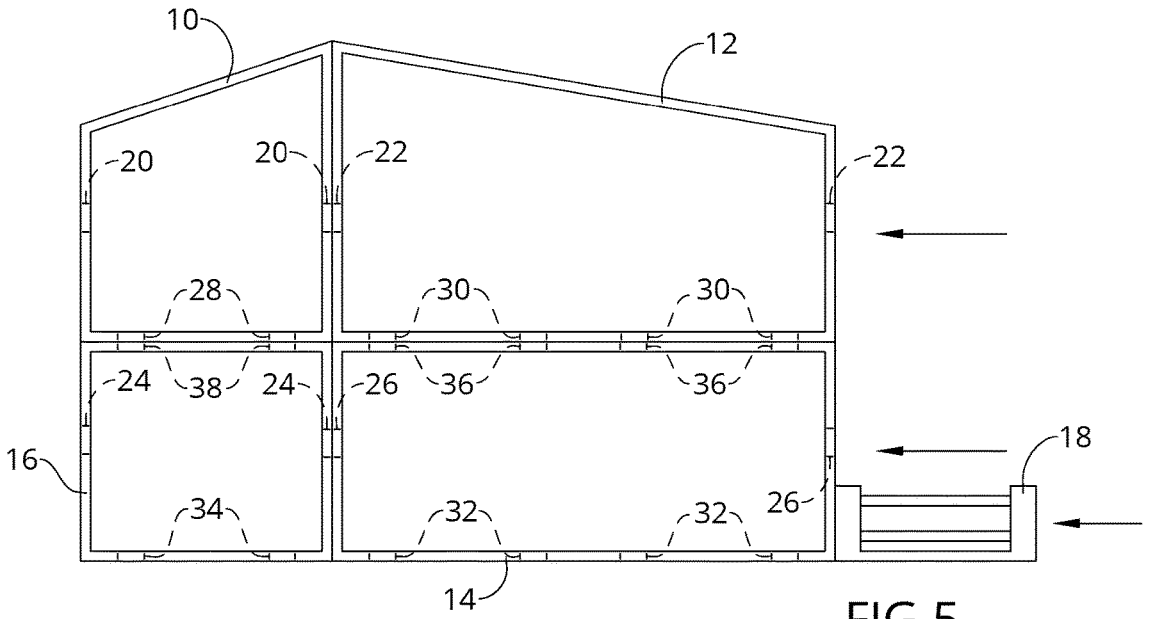
FIG. 5 is a side view exemplifying attachment of the dollhouse components in a first alternate arrangement.
Figure 6:
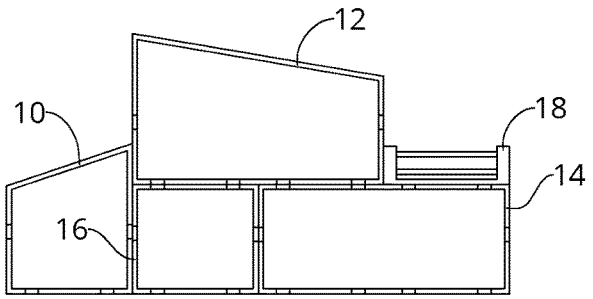
FIG. 6 is a side view exemplifying attachment of the dollhouse components in a second alternate arrangement.
Figure 7:
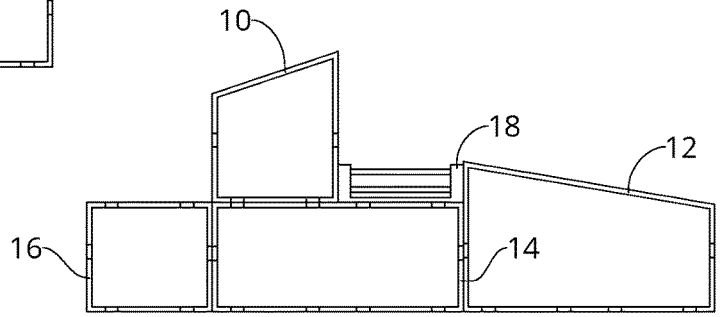
FIG. 7 is a side view exemplifying attachment of the dollhouse components in a third alternate arrangement.
Figure 8:
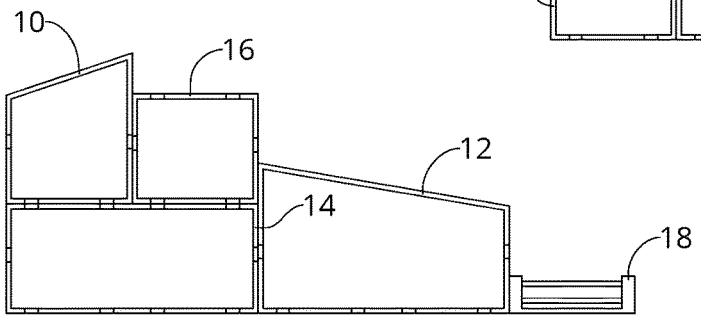
FIG. 8 is a side view exemplifying attachment of the dollhouse components in a fourth alternate arrangement.

According to various embodiments as depicted in FIGS. 1-8, modular dollhouse 1 may comprise a multiple number of individual rooms 1A, wherein 2 or more of the rooms may include strategically placed magnets that allows the rooms to "snap" together side to side and/or top to bottom to create various layouts or arrangements. To this end, each "magnetic" room comprises one or more magnet(s) on its top, bottom, and/or side wall(s), wherein said magnet(s) are configured to mate with corresponding magnet(s) on the walls of another magnetic room. The mating magnets have aligned polarities and corresponding positions that allow the rooms to snap together by magnetic joinder of the walls. In certain embodiments, the magnets may be provided in magnetic sets, wherein each magnetic set includes multiple magnets, and wherein the two or more rooms are each provided with corresponding magnetic sets that are both spatially and polarly aligned, so that the magnetic set of one room magnetically snaps into a specific/directed positional orientation with the magnetic set of the other room. It shall be appreciated that single magnetic elements rather than magnetic sets may also be used to direct a positional orientation between the rooms in alternate embodiments.

In certain embodiments, modular dollhouse 1 may comprise at least 2 rooms, or at least 3 rooms, or at least 4 rooms, or at least 5 rooms. Each room may be made up of a floor 1B (also referred to as a "bottom wall"); and one or more side structure(s) 1C (also referred to as "side walls") or at least two side structures 1C extending upwards from the bottom floor. In further embodiments, at least a portion of rooms 1A may comprise a roof 1D (also referred to as a "top wall") coupled proximate the top edges of the side structure 1C.

In certain embodiments, floors 1B of rooms 1A may each be generally planar. In further embodiments, floors 1B may each have a rectangular and/or square perimeter, as shown in the figures (as used herein, the term 'rectangular' shall include square). In some embodiments, side structures 1C may each be generally planar. In further embodiments, side structures 1C may each have a rectangular and/or square perimeter, as shown in the figures. In certain embodiments, roof(s) 1D may each be generally planar. In further embodiments, roof(s) 1D may each have a rectangular and/or square perimeter, as shown in the figures. In some embodiments, each room may be a permanent structure and/or may be assembled in a permanent fashion, e.g., with screws. In other embodiments, each room may be configured to non-permanently assemble.

It shall be appreciated that floor(s) 1B, side structure(s) 1C, and/or roof(s) 1D may incorporate various design elements, decorative components, cutouts, composite components, and the like. For example, as depicted in the figures, side structures 1C may include "entrance way" openings 1E, or may be made up of "fence" components 1F. Other such elements may include windows, doors, floor tiles, roof tiles, etc.

In certain embodiments, at least one side wall magnetic set is provided on at least one side wall 1C of at least two rooms 1A of dollhouse 1, wherein a side wall magnetic set of any one of the rooms is configured to mate with a side wall magnetic set provided in any one of the other rooms, and wherein each side wall magnetic set includes at least two magnets which are physically spaced apart from one another.

In certain embodiments, at least one floor magnetic set is provided on a floor 1B of at least one room 1A of dollhouse 1, and at least one roof magnetic set is provided on a roof 1D of at least one other room 1A of dollhouse 1, wherein a floor magnetic set of any one of the rooms is configured to mate with a roof magnetic set in any one of the other rooms, and wherein each floor magnetic set and roof magnetic set includes at least two magnets, or 4 magnets which are physically spaced apart from one another. This allows dollhouse 1 to be rearranged easily while achieving stability with each layout due to magnetic strength, and the spatial alignment of the magnets.

In one embodiment, each room may have a magnetic set comprising 2 magnets on the outer side of its right wall and a magnetic set comprising 2 magnets on the outer side of its left wall, wherein the magnets on a right-side wall of any one of the rooms is configured to magnetically and positionally align with the magnets on the left-side wall of any of the other rooms (or vice versa) to magnetically join the rooms together side-to side. In further embodiments, each of the rooms may include at least one set of 4 magnets on the outer side of its top wall and at least one set of 4 magnets on the outer side of its bottom wall, wherein the magnets on the top wall of any one of the rooms is configured to magnetically and positionally align with the magnets on the bottom wall of any of the other rooms (or vice versa) to magnetically join the rooms together top-to-bottom. In some embodiments, the magnets may be arranged in a way which forces the rooms to be oriented in certain directions (e.g., with their open sides facing the same way, with the rooftop slanting in a certain direction, etc.).

In certain embodiments, the rooms may have different designs and sizes. For example, as depicted in the figures, certain rooms may be taller and/or longer than other rooms, and may include features such as arched openings, a slanted rooftop, a leveled rooftop, a fence, etc.

In certain embodiments, each individual room may be assembled with screws to provide a permanent room unit. In one embodiment, 4 screws may be inserted from the floor into the side wall and 4 screws may be inserted from the roof into the side wall, while the back panel of each room may slide into back wall grooves on each of the 4 walls. Thus, once rooms the rooms are assembled, they may remain in that state. In further embodiments, front wall grooves may also be added to the front of each wall to allow the polarity of the magnets to be reversed so that the rooms can be constructed in the opposite layout. It shall be appreciated that in alternate embodiments, the rooms may be assembled by different attachment mechanisms as known in the art. In some embodiments, modular dollhouse 1 may be provided to the consumer with the room units preassembled, while in other embodiments, the consumer (e.g., parent or child) may be required to assemble the rooms into permanent or semi-permanent units prior to use. In certain embodiments, an adult may assemble the rooms with screws as described above. The child may then arrange the rooms so that the magnets bind together into a layout he or she chooses.

Example

According to an exemplary embodiment as shown in the figures, modular dollhouse 1 comprises 4 magnetic rooms, including a first room 10, a second room 12, a third room 14, a fourth room 16. Dollhouse 1 further includes a fifth "patio" room 18 which is non-magnetic.

First room 10 includes a first room floor 10B; two first room side walls 10C including a left side wall and a right side wall; and a first room roof 10D. First room floor 10B includes 4 floor magnets 28 that together form a first room floor magnetic set. The two first room side walls 10C each include two side wall magnets 20, providing a left side wall magnetic set and a right side wall magnetic set in the respective side walls of the first room. The first room roof 10D is slanted and does not include magnets. Second room 12 includes a second room floor 12B; two second room side walls 12C, including a left side wall and a right side wall; and a second room roof 12D. Second room floor 12B includes 8 floor magnets 30, wherein the 8 floor magnets are arranged in a right-side rectangular formation and a left-side rectangular formation to provide a right side floor magnetic set and a left side floor magnetic set in the second room (as used herein, the term 'rectangular' includes a square). The two second room side walls 12C each include two side wall magnets 22, providing a left side wall magnetic set and a right side wall magnetic set in the respective side walls of the second room. The second room roof 12D is slanted and does not include magnets. Third room 14 includes a third room floor 14B; two third room side walls 14C, including a left side wall and a right side wall; and a third room roof 14D. Third room floor 14B includes 8 floor magnets 32, wherein the 8 floor magnets are arranged in a right-side rectangular formation and a left-side rectangular formation to provide a right side floor magnetic set and a left side floor magnetic set in the third room. The two third room side walls 14C may each include two side wall magnets 24, providing a left side wall magnetic set and a right side wall magnetic set in the respective side walls of the third room. The third room roof 14D may include 8 roof magnets 36, wherein the 8 roof magnets are arranged in a right-side rectangular formation and a left-side rectangular formation to provide a right side roof magnetic set and a left side roof magnetic set in the third room. Fourth room 16 includes a fourth room floor 16B; two fourth room side walls 16C, including a left side wall and a right side wall; and a fourth room roof 16D. Fourth room floor 16B include 4 floor magnets 34 that are arranged in a rectangular formation to provide a floor magnetic set in the fourth room. The two fourth room side walls 16C may each include two side wall magnets 26, providing a left side wall magnetic set and a right side wall magnetic set in the respective side walls of the first room. The fourth room roof 16D includes 4 roof magnets 38 that are arranged in a rectangular formation to provide a roof magnetic set in the fourth room.

The polarity and spatial arrangement of the magnetic sets in the four rooms allows the left side wall magnetic set in any one of the rooms to mate with the right side wall magnetic set in any one of the other rooms, and further allows any one of the roof magnetic sets (including right or left side sets) in any one of the rooms to mate with any one of the floor magnetic sets (including right or left side sets) in any one of the other rooms. The polarity orientation of the magnetic sets further forces the rooms to maintain consistent front and back arrangements, when the rooms are positioned right side up. As such, the 4 magnetic rooms can be magnetically detached from one another, and reattached in a variety of different arrangements, as exemplified in the figures. For example, first room 10 may be attached to the left or right side of any one of rooms 12, 14, or 16. First room 10 may further be attached to the roofs of rooms 14 or 16. While the fifth patio room 18 is non-magnetic, different arrangements may allow it to be fitted between or adjacent to other rooms. Additionally, due to the disparity in sizes of the rooms, certain arrangements allow a side wall of one room to extend above the side wall of another room, and/or to extend over two side walls of adjacent stacked rooms, and/or for a floor of one room to extend over the rooftops of two rooms, etc.

Thus, the disclosed subject matter encourages children to engage in imaginative play and offers the ability to create a variety of multiple layouts while holding each layout in a stable and safe position. The strength of the magnet is such that a child can detach the rooms with minimal effort, yet the magnetic bond is strong enough to hold the chosen layout, with the magnets holding the rooms side to side and/or top to bottom. In certain embodiments, expansion units may be sold separately to provide further opportunity to rearrange and expand the dollhouse.

It shall be appreciated that the disclosed dollhouse can have multiple configurations in different embodiments. It shall be appreciated, any number of magnetic and non-magnetic rooms and/or room designs may be used in alternate embodiments. For example, the patio room may also include magnetic wall(s) and/or other rooms may be added to the in the above-described embodiment. Additionally, any number of magnets, and magnets of various geometric configurations (e.g., magnetic bars instead of discs) may be used within the walls of the rooms in alternate embodiments. It shall be appreciated that the disclosed system may be adapted for use with other toys and systems wherein the modularity aspect provided by the magnets can be used to enable a variety of layouts of base components of the system.

It shall be appreciated that the components of the dollhouse described in several embodiments herein may comprise any alternative known materials in the field and be of any size and/or dimensions. It shall be appreciated that the components of the dollhouse described herein may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A modular doll house, comprising: a multiple number of individual rooms including a first room comprising a floor, two opposing side walls, and a roof, the side walls extending between the floor and the roof, and a second room comprising a floor, two opposing side walls, and a roof, the side walls extending between the floor and the roof; at least one first room magnetic set in the floor and in at least one of the side walls of the first room; at least one second room magnetic set in the floor and in at least one of the side walls of the second room, wherein each magnetic set of the first room magnetic set and the second room magnetic set comprises at least two magnets that are physically spaced apart from one another, wherein the first room magnetic set and the second room magnetic set are spatially and polarly aligned with one another, so that they are able to magnetically mate in a directed positional orientation; wherein the floor, side walls, and roof of each of the individual rooms is configured to assemble into an interiorly accessible permanent structure.

2. The modular dollhouse of claim 1, wherein the dollhouse comprises a third room including a floor, two opposing side walls, and a roof, and at least one third room magnetic set in the floor and at least one of the side walls of the third room, wherein the third room magnetic set is spatially and polarly aligned with the first room magnetic set and the second room magnetic set, so that it is able to magnetically mate with either one of the first room magnetic set and the second room magnetic set in a directed positional orientation.

3. The modular dollhouse of claim 2, wherein the first room magnetic set includes a first side wall magnetic set, and a second side wall magnetic set in the first and second side walls of the first room, respectively, wherein the second room magnetic set includes a first side wall magnetic set, and a second side wall magnetic set in the first and second side walls of the second room, respectively, wherein the third room magnetic set includes a first side wall magnetic set, and a second side wall magnetic set in the first and second side walls of the third room, respectively, and wherein the first side wall magnetic set in any one of the first room, the second room, and the third room is configured to spatially and magnetically mate with the second side wall magnetic set in any one of the other rooms of the first room, the second room, and the third room.

4. The modular dollhouse of claim 2, wherein at least one of the first room, the second room, and the third room magnetic sets further includes a roof magnetic set in the roof of the respective room, wherein the floor magnetic set in any one of the first room, the second room, and the third room is configured to spatially and magnetically mate with the roof magnetic set in any one of the other rooms of the first room, the second room, and the third room.

5. The modular dollhouse of claim 4, wherein each floor magnetic set and roof magnetic set comprises four magnets in a rectangular formation.

6. The modular dollhouse of claim 4, wherein the floors, side walls, and roofs of the first, second, and third rooms are generally planer with a rectangular perimeter.

7. The modular dollhouse of claim 2, wherein at least one of the roofs of the first, second, and third rooms is slanted.

8. The modular dollhouse of claim 1, wherein the dollhouse comprises at least four individual rooms.

* * * * *